US007842895B2

(12) United States Patent
Lee

(10) Patent No.: US 7,842,895 B2
(45) Date of Patent: Nov. 30, 2010

(54) KEY SWITCH STRUCTURE FOR INPUT DEVICE

(76) Inventor: Ching-Ping Lee, 1F, No. 363, Sec. 1, Wen-Hua Road, Panchiao City, Taipei Hsien (TW)

( * ) Notice: Subject to any disclaimer, the term of this patent is extended or adjusted under 35 U.S.C. 154(b) by 63 days.

(21) Appl. No.: 12/409,497

(22) Filed: Mar. 24, 2009

(65) Prior Publication Data

US 2010/0243419 A1 Sep. 30, 2010

(51) Int. Cl.
*H01H 13/70* (2006.01)

(52) U.S. Cl. ..... 200/344; 200/314; 200/341

(58) Field of Classification Search ..... 200/344, 200/310–314, 317, 343, 5 A, 276, 276.1, 200/16 A, 600, 512–520, 5 R, 341, 237, 242, 200/245, 253

See application file for complete search history.

(56) References Cited

U.S. PATENT DOCUMENTS 6,686,549 B2 * 2/2004 Douzono et al. ..... 200/341
7,525,056 B2 * 4/2009 Chiba et al. ..... 200/314
7,709,760 B2 * 5/2010 Chen et al. ..... 200/314

* cited by examiner

*Primary Examiner*—Edwin A. Leon

(57) ABSTRACT

A key switch structure used in an input device is disclosed to include a circuit module, a key cap supported on a vertically compressible and elastically deformable hollow actuation member of a rubber membrane of the circuit board, a positioning board fastened to the circuit module, and two links arranged in a crossed manner and coupled between coupling portions of the positioning and the key cap to guide vertical movement of the key cap by means of a scissor action when the key cap is pressed by a user to compress the vertically compressible and elastically deformable hollow actuation member in triggering a circuit module to produce a control signal.

17 Claims, 9 Drawing Sheets

KEY SWITCH STRUCTURE FOR INPUT DEVICE

BACKGROUND OF THE INVENTION

1. Field of the Invention

The present invention relates to an input device and more particularly, to a key switch structure for input device, which uses two links arranged in a cross manner for performing a scissors action to support a key cap in balance, stabilizing vertical movement of the key cap when the key cap is clicked to drive a circuit module in producing a control signal. This simple design of key switch structure is suitable for mass production, lowering the manufacturing cost.

2. Description of the Related Art

Following fast development of computer-related technology, many practical and functional electronic products have been continuously created and have appeared on the market. Most commercial electronic products have an input device made in the form of a mouse, keyboard, joystick or light gun for data or command entry. For different applications, different input devices shall be used. For example, a keyboard for notebook computer is quite different from the configuration for desk computer. A notebook computer has light, thin, short and small characteristics. Therefore, the key switch structure of a keyboard for desk computer cannot be directly used in a keyboard for notebook computer. It must be specially configured to fit the requirements for notebook computer.

A conventional key switch structure for keyboard has a linking mechanism provided between a key cap and a bottom board to support vertical movement of the key cap. The linking mechanism may be made in the form of a cross-linkage (scissors-structure), rotary structure or sliding structure. FIG. 9 illustrates a key switch structure for input device according to the prior art. According to this design, the key switch structure comprises a bottom board C, a circuit board D supported on the bottom board C and carrying a rubber cone D1, a key cap B, and a linking mechanism A coupled between axle holders C1 of the bottom board C and axle holders B1 of the key cap B around the rubber cone D1. The linking mechanism A includes an inner link A1 and an outer link A2. The inner link A1 has two pivot pins A11 bilaterally disposed on the middle and respectively pivotally coupled to respective pivot holes A21 of the outer link A2. Further, the inner link A1 and the outer link A2 have the respective coupling rods A12 and A22 respectively coupled to the axle holders C1 of the bottom board C and the axle holders B1 of the key cap B. When a user clicks the key cap B, the rubber cone D1 is compressed to trigger the circuit board D, causing the circuit board D to output a control signal. At the same time, the inner link A1 and the outer link A2 are moved relative to each other to support vertical movement of the key cap B.

The aforesaid key switch structure is functional, however it still has drawbacks. The pivot pins A11 of the inner link A1 may be broken accidentally during installation by labor, or may break easily due to a stress concentration after a long use of the key switch structure. Further, the alignment between the pivot pins A11 of the inner link A1 and the pivot holes A21 of the outer link A2 is quite important. A small alignment error between the pivot pins A11 and the pivot holes A21 may result in vibration and malfunctioning of the linking mechanism during operation of the key switch structure. Further, the assembly procedure of this design key switch structure is complicated.

SUMMARY OF THE INVENTION

The present invention has been accomplished under the circumstances in view. A key switch structure for input device in accordance with the present invention is comprised of a circuit module, a key cap and a linking mechanism. The linking mechanism comprises a first link and a second link. The first link has two oblique bearing portions respectively supported on a respective shoulder of the second link in a crossed manner such that the first link and the second link are moved in scissor action to support the key cap in balance when a user pressed the key cap to trigger the circuit module in outputting a control signal. The scissor-action design of the linking mechanism facilitates quick installation of the key switch structure by an automatic assembling tool. Therefore, the key switch structure is suitable for mass production to improve the productivity and to lower the manufacturing cost.

Further, the first link and the second link extend across each other and are movable in scissor action to lower or lift the key cap while keeping the key cap in balance.

Further, when the key cap is pressed and lowered to the position where a contact portion of an elastically deformable hollow actuation member of a rubber membrane of the circuit module touches a corresponding switching contact of a circuit board of the circuit module, the first link is received in recessed receiving portions of the second link, therefore, the scissor-action design of the first and second links of the linking mechanism enables the height of the elastically deformable hollow actuation member to be minimized, satisfying low-profile requirements.

DETAILED DESCRIPTION OF THE PREFERRED EMBODIMENT

Figure 1:
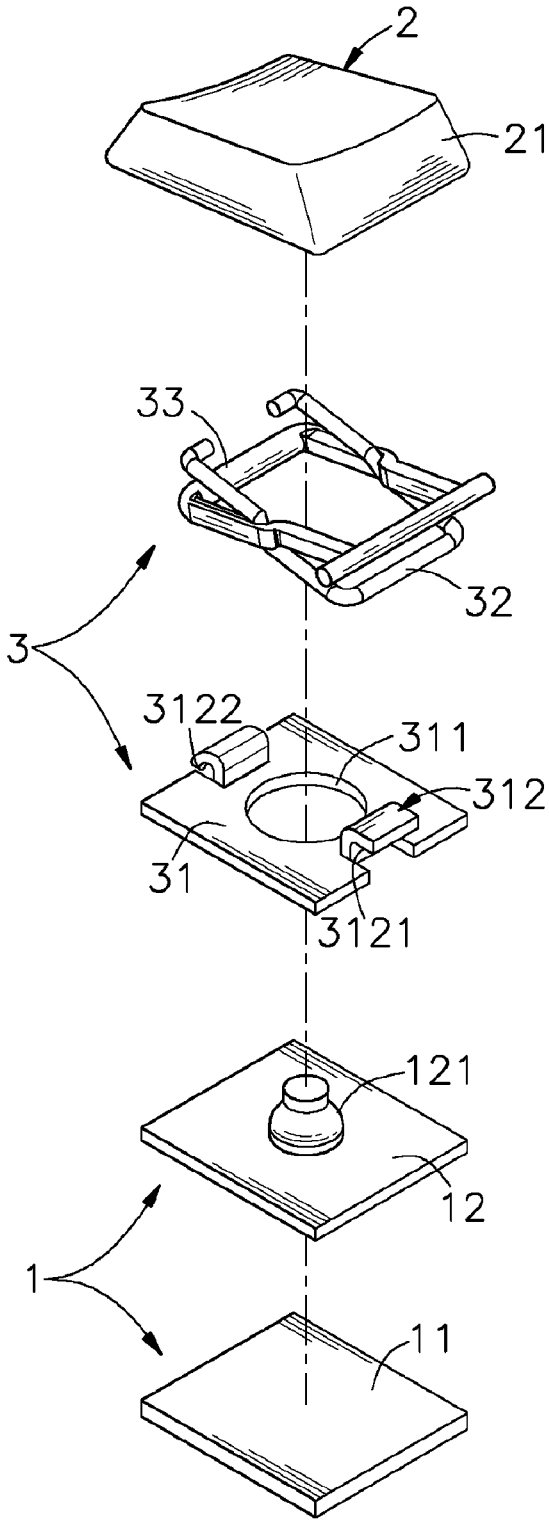
FIG. 1 is an exploded view of a key switch structure for input device in accordance with a first embodiment of the present invention.
Figure 2:
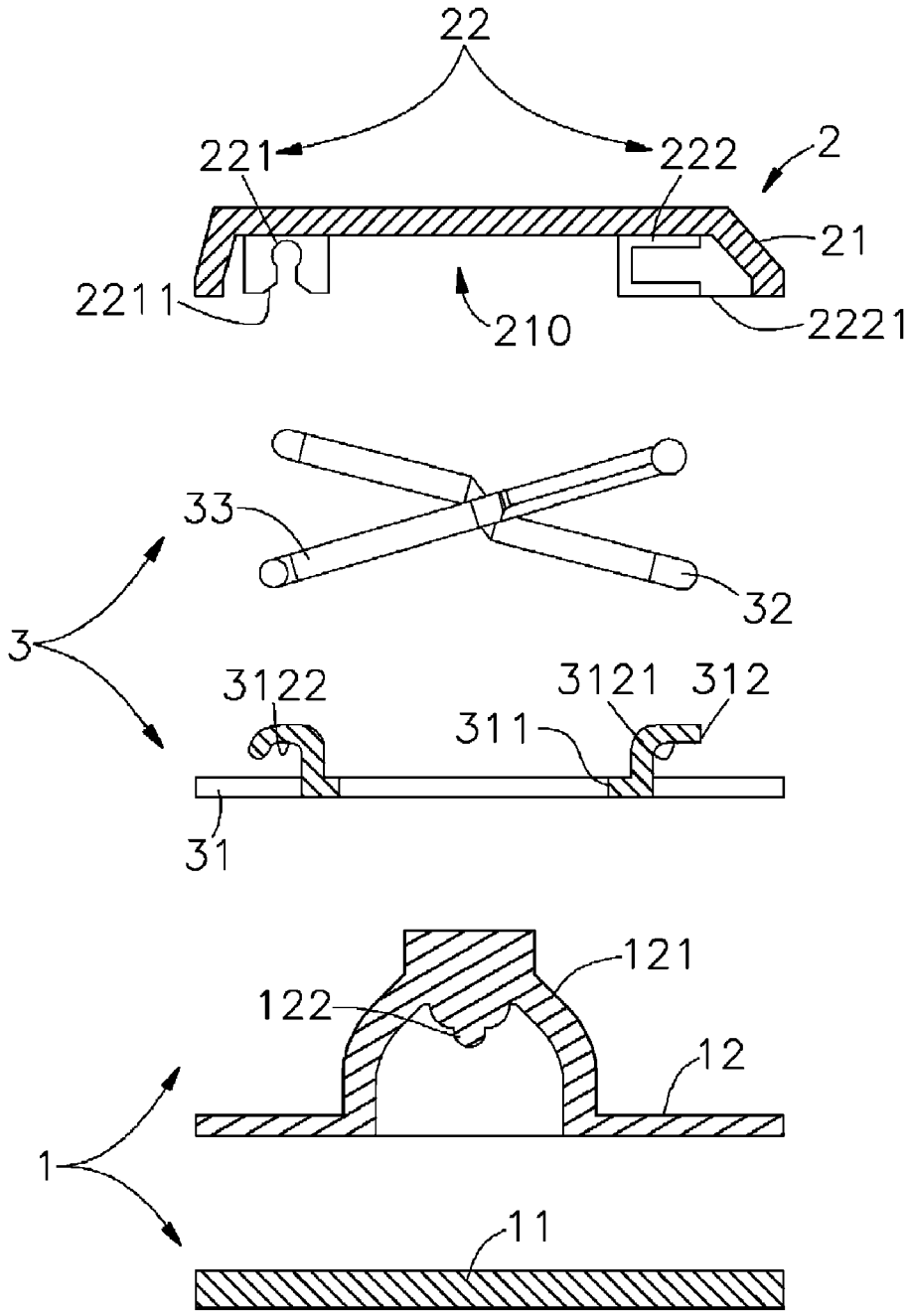
FIG. 2 is a sectional side view in an enlarged scale of FIG. 1.
Figure 3:
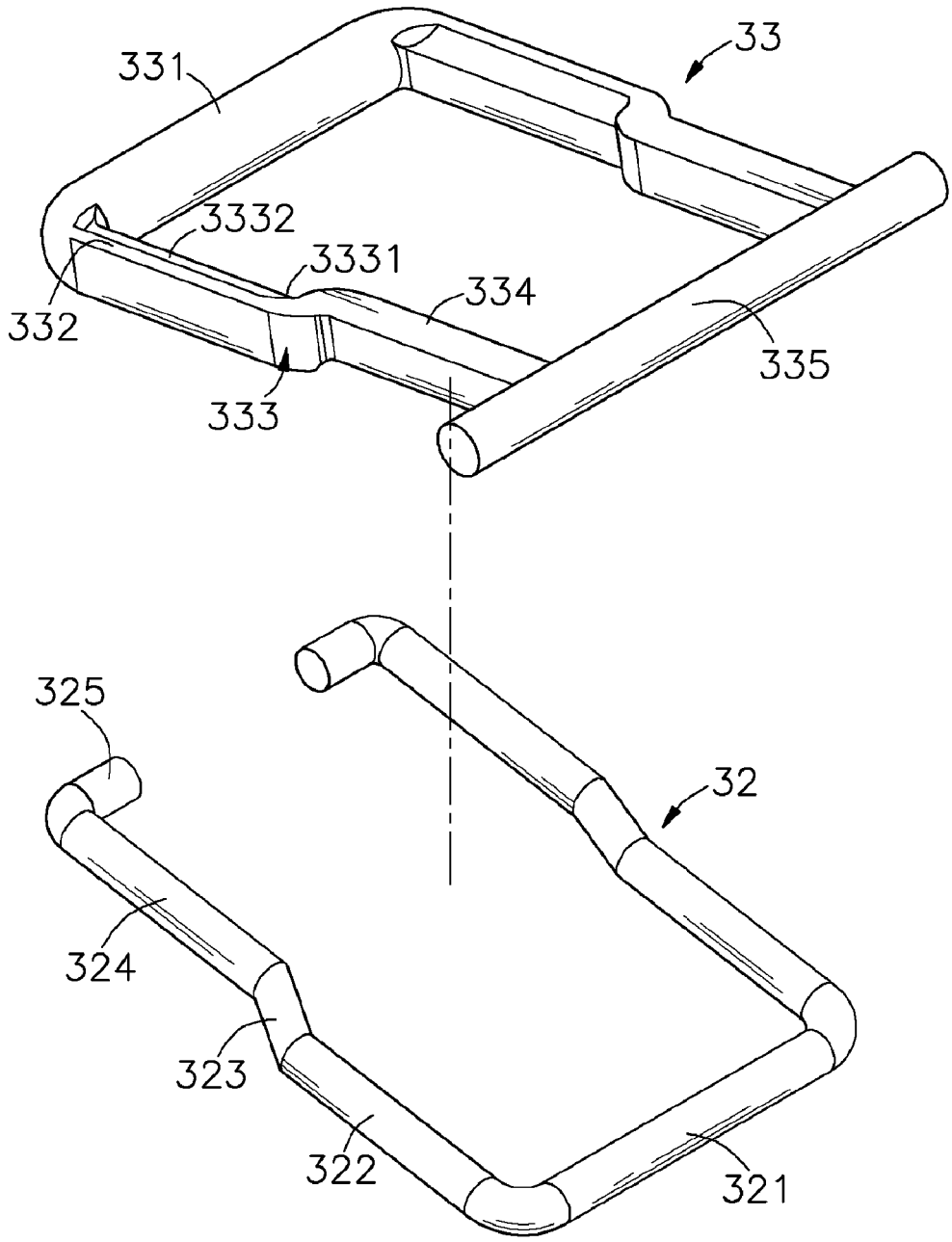
FIG. 3 is an elevational view of the first link and the second link according to the first embodiment of the present invention.
Figure 4:
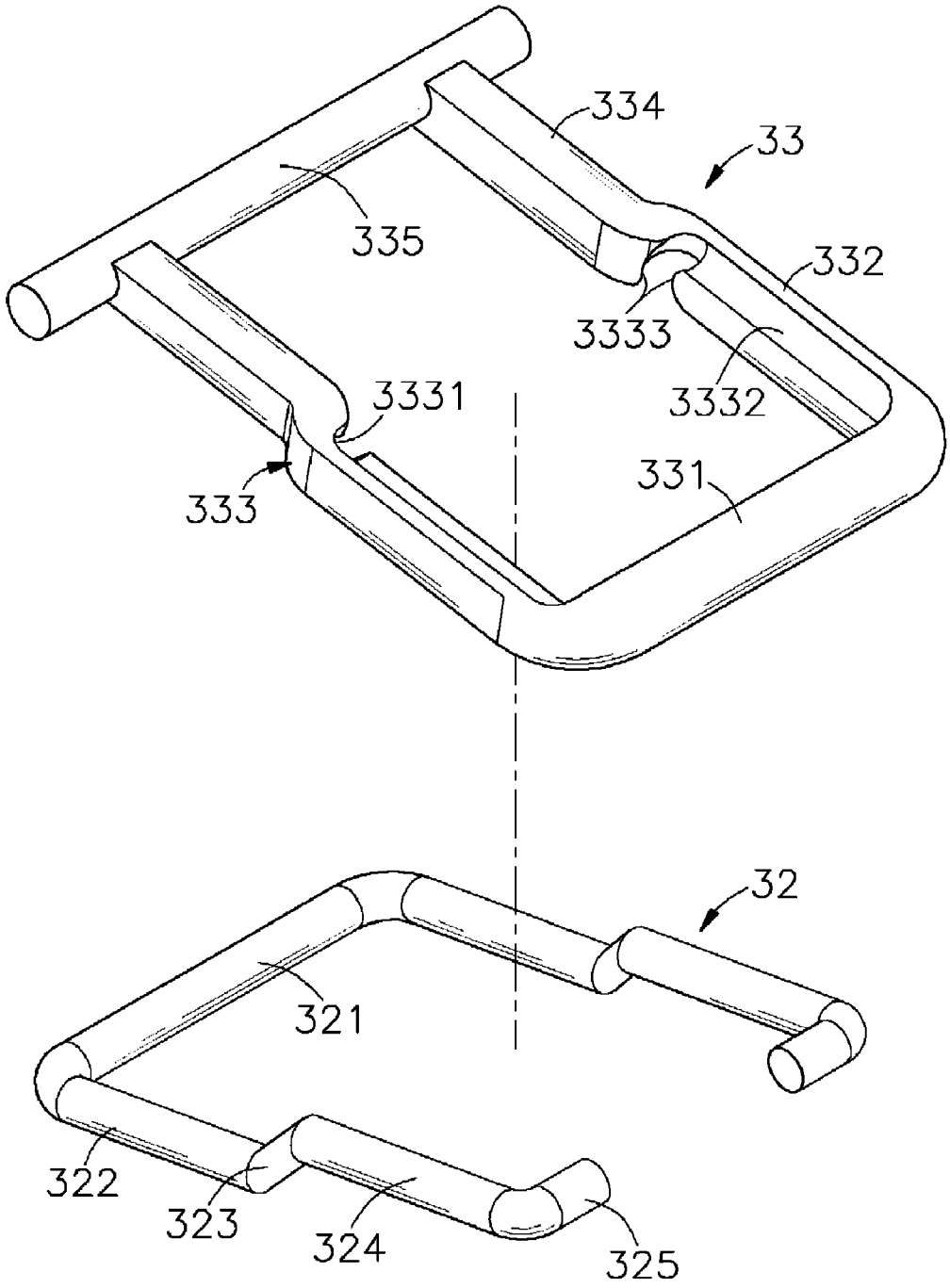
FIG. 4 corresponds to FIG. 3 when viewed from another angle.

Referring to FIGS. 1~4, a key switch structure of an input device in accordance with a first embodiment of the present invention is shown comprising a circuit module 1, a key cap 2 and a linking mechanism 3.

The circuit module 1 comprises a circuit board 11, and a rubber membrane 12 positioned on the circuit board 11. The circuit board 11 has arranged therein a circuit layout with multiple switching contacts. The rubber membrane 12 comprises at least one compressible and elastically deformable hollow actuation member 121 that has a contact portion 122 downwardly extended from the top thereof and spaced above one switching contact of the circuit board 11.

The key cap 2 is supported on the one compressible and elastically deformable hollow actuation member 121 of the rubber membrane 12 above the circuit board 11, comprising a trapezoidal key cap body 21, a bottom accommodation space 210 defined in the bottom side of the trapezoidal key cap body 21, two pairs of coupling devices 22 bilaterally located on the bottom side of the trapezoidal key cap body 21 within the bottom accommodation space 210 and coupled to the linking mechanism 3. Each coupling device 22 of the first pair defines a downwardly extending water drop-like coupling hole 221 and a smoothly curved guide surface portion 2211 at the bottom side of the downwardly extending water drop-like coupling hole 221. Each coupling device 22 of the second pair defines a horizontal sliding groove 222, and a bottom entrance 2221 in communication with the horizontal sliding groove 222.

The linking mechanism 3 is received in the bottom accommodation space 210 of the key cap 2, comprising a positioning board 31 stacked on the rubber membrane 12 above the circuit board 11, a first link 32 obliquely coupled between the first pair of coupling devices 22 of the key cap 2 and the positioning board 31, and a second link 33 obliquely coupled between the second pair of coupling devices 22 of the key cap 2 and the positioning board 31 and extending across the first link 32 for enabling the key cap 2 to be moved upward and down between two positions to compress or release one elastically deformable hollow actuation member 121 of the rubber membrane 12. The positioning board 31 comprises an opening 311 for the passing of one elastically deformable hollow actuation member 121 of the rubber membrane 12, and two coupling portions 312 upwardly protruded from the top wall thereof and disposed at two opposite lateral sides relative to the opening 311. Each coupling portion 312 defines a coupling groove 3121. Further, one coupling portion 312 has its free end curving downwards, defining a stop surface 3122

The first link 32 comprises a cylindrical base 321 coupled to the coupling groove 3121 of one coupling portion 312 of the positioning board 31, two pivot pins 325 respectively coupled to the first pair of coupling devices 22 of the key cap 2, two lower arms 322 respectively perpendicularly extended from the two distal ends of the cylindrical base 31, two upper arms 324 respectively connected between the lower arms 322 and the pivot pins 325, and two oblique bearing portions 323 respectively connected between the lower arms 322 and the upper arms 324.

The second link 33 comprises a cylindrical base 331 coupled to the coupling groove 3121 of the other coupling portion 312 of the positioning board 31, a transverse coupling rod 335 coupled to the second pair of coupling devices 22 of the key cap 2, two lower arms 332 respectively perpendicularly extended from the two distal ends of the cylindrical base 331, two upper arms 334 respectively perpendicularly extended from the two distal ends of the transverse coupling rod 335, two shoulders 333 respectively connected between the lower arms 332 and the upper arms 334 and respectively abutted against the oblique bearing portions 323 of the first link 32, two locating notches 3331 respectively defined in the inner side of each of the shoulders 333 for the positioning of the oblique bearing portions 323 of the first link 32, recessed receiving portions 3332 respectively defined in the inner side of each of the lower arms 332 and the upper arms 334, and a plurality of chamfered edges 3333 respectively connected between the locating notches 3331 and the recessed receiving portions 3332.

The circuit board 11 of the aforesaid circuit module 1 can be a flexible circuit board made of a flexible substrate. Further, the circuit board 11 can be made by bonding two substrates, which carry a respective circuit layout, by means of a conducting adhesive to form a circuit layer. Further, the rubber membrane 12 can be formed integral with the circuit board 11, or separately made and then positioned on the circuit board 11. Further, the elastically deformable hollow actuation member 121 can be molded from silicon rubber, rubber, or any other elastically deformable material. Further, light emitting means can be mounted on the inside or outside of the circuit board 11. Further, the key cap 2 can be metal or plastic cap coated with a coating layer and carrying a design that can be pattern, letter, character or symbol indicative of the position arrangement of the key cap 2 and formed on the key cap 2 by means of a laser technique.

During installation of the present invention, couple the cylindrical bases 321 and 331 of the first and second links 32 and 33 to the coupling portions 312 of the positioning board 31 respectively, and then squeeze the two upper arms 324 of the first link 32 toward each other and then insert the two upper arms 324 of the first link 32 through the space defined between the two lower arms 332 of the second link 33 to have the two shoulders 333 of the second link 33 be respectively supported on the oblique bearing portions 323 of the first link 32. At this time, the oblique bearing portions 323 of the first link 32 are respectively received in the locating notches 3331 of the second link 33, and the cylindrical bases 321 and 331 of the first and second links 32 and 33 are kept in the coupling grooves 3121 of the coupling portions 312 of the positioning board 31 respectively. Thus, the first link 31 and the second link 32 are pivotally coupled together for performing a scissors action.

After the positioning board 31, first link 32 and second link 33 of the linking mechanism 3 are assembled, the trapezoidal key cap body 21 of the key cap 2 is capped on the linking mechanism 3 to keep the water drop-like coupling holes 221 of the first pair of coupling devices 22 of the key cap 2 in alignment with the two pivot pins 325 of the first link 32 respectively and to have the transverse coupling rod 335 of the second link 33 be inserted through the bottom entrance 2221 of each of the second pair of coupling devices 22 of the key cap 2 into the respective horizontal sliding grooves 222, and then an upward pressure is applied to the linking mechanism 3 against the key cap 2 to force the two pivot pins 325 of the first link 32 along the respective guide surface portions 2211 into the water drop-like coupling holes 221 of the first pair of coupling devices 22 of the key cap 2 respectively. This installation procedure is quite easy and simple, and can be done rapidly by means of an automatic assembling tool, achieving mass production of the input device and lowering the related manufacturing cost.

After coupling between the linking mechanism 3 and the key cap 2, one elastically deformable hollow actuation member 121 of the rubber membrane 12 is inserted through the opening 311 of the positioning board 31 into the bottom accommodation space 210 of the key cap 2 and stopped against the bottom wall of the trapezoidal key cap body 21 of the key cap 2. Thus, the key cap 2 is kept suspending above the circuit module 1 over the associating elastically deformable hollow actuation member 121 and the first link 32 and second link 33 of the linking mechanism 3 are received in the bottom accommodation space 210 of the key cap 2 so that the key cap 2 can be pressed by a user to compress the associating elastically deformable hollow actuation member 121.

Figure 5:
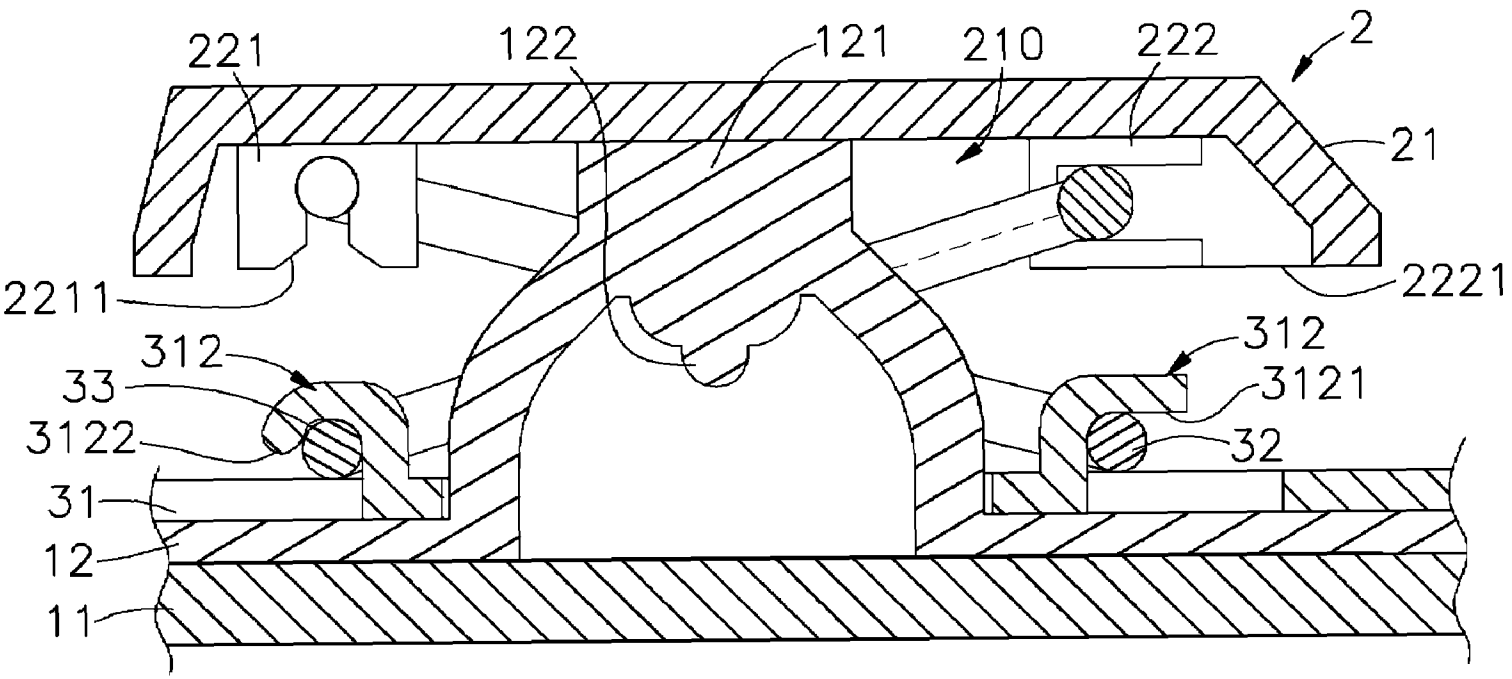
FIG. 5 is a sectional assembly view of the key switch structure in accordance with the present invention.
Figure 6:
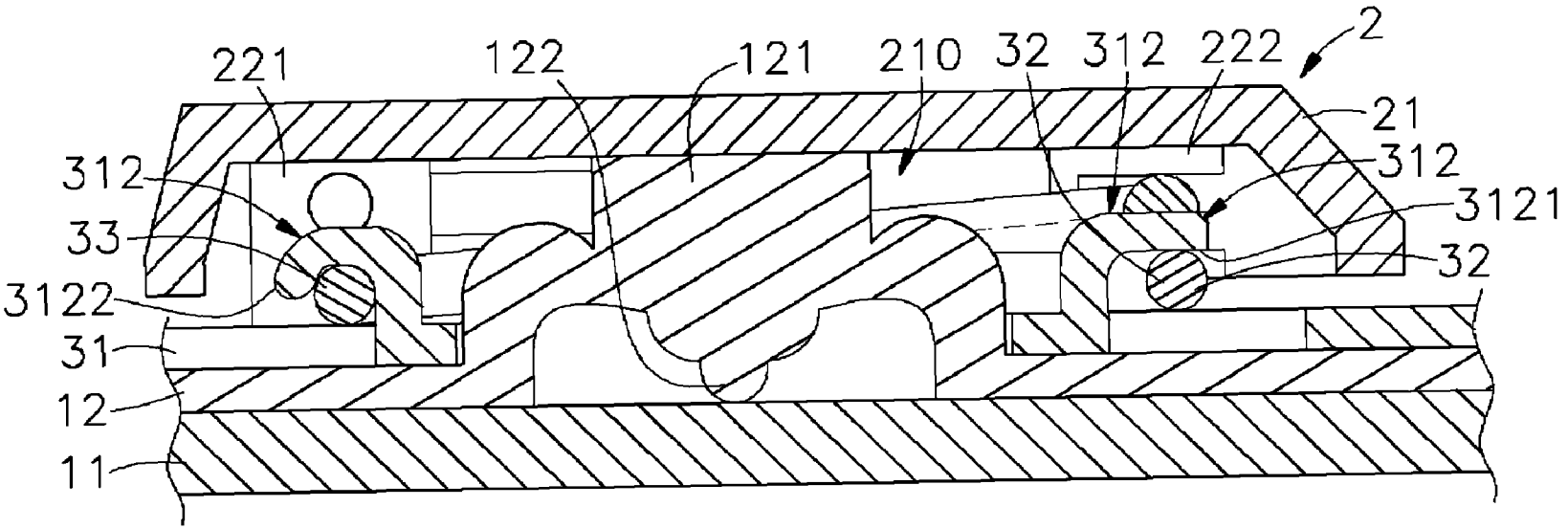
FIG. 6 corresponds to FIG. 5, showing the key cap pressed.

Referring to FIGS. 5 and 6 and FIGS. 1 and 4 again, when a user presses the key cap 2, the first link 32 and the second link 33 are moved relative to each other to perform a scissor action, allowing the key cap 2 be lowered to compress the associating elastically deformable hollow actuation member 121 of the rubber membrane 12 and to further force the contact portion 122 of the associating elastically deformable hollow actuation member 121 into contact with the respective switching contact of the circuit board 11, thereby causing the circuit board 11 to output a corresponding control signal. When the user released the hand from the key cap 2, the elastically deformable hollow actuation member 121 of the rubber membrane 12 immediately returns to its former shape subject to the effect of its elastic material property, thereby returning the key cap 2.

During up stroke or down stroke of the key cap 2, the two pivot pins 325 of the first link 32 are respectively rotated in the water drop-like coupling holes 221 of the first pair of coupling devices 22 of the key cap 2, the transverse coupling rod 335 of the second link 33 is moved in the respective horizontal sliding grooves 222 of the second pair of coupling devices 22 of the key cap 2, the shoulders 333 of the second link 33 are respectively supported on the oblique bearing portions 323 of the first link 32, and the cylindrical bases 321 and 331 of the first and second links 32 and 33 are moved in the respective coupling grooves 3121 of the coupling portions 312 of the positioning board 31 respectively, and therefore the key cap 2 is stably moved upwards or downwards without vibration, and the downward pressure from the key cap 2 can be evenly and vertically applied to the associating elastically deformable hollow actuation member 121 to force the contact portion 122 of the associating elastically deformable hollow actuation member 121 into contact with the respective switching contact of the circuit board 11 accurately.

Further, the oblique bearing portions 323 of the first link 32 are respectively movably received in the locating notches 3331 of the second link 33. When the key cap 2 is pressed and lowered to the lower limit position where the contact portion 122 of the associating elastically deformable hollow actuation member 121 touches the respective switching contact of the circuit board 11, the first link 32 is received in the recessed receiving portions 3332 at the inner sides of the lower arms 332 and upper arms 334 of the second link 33. Therefore, the scissor-action design of the first and second links 32 and 33 of the linking mechanism 3 enables the height of the elastically deformable hollow actuation member 121 to be minimized, satisfying low-profile requirements.

Figure 7:
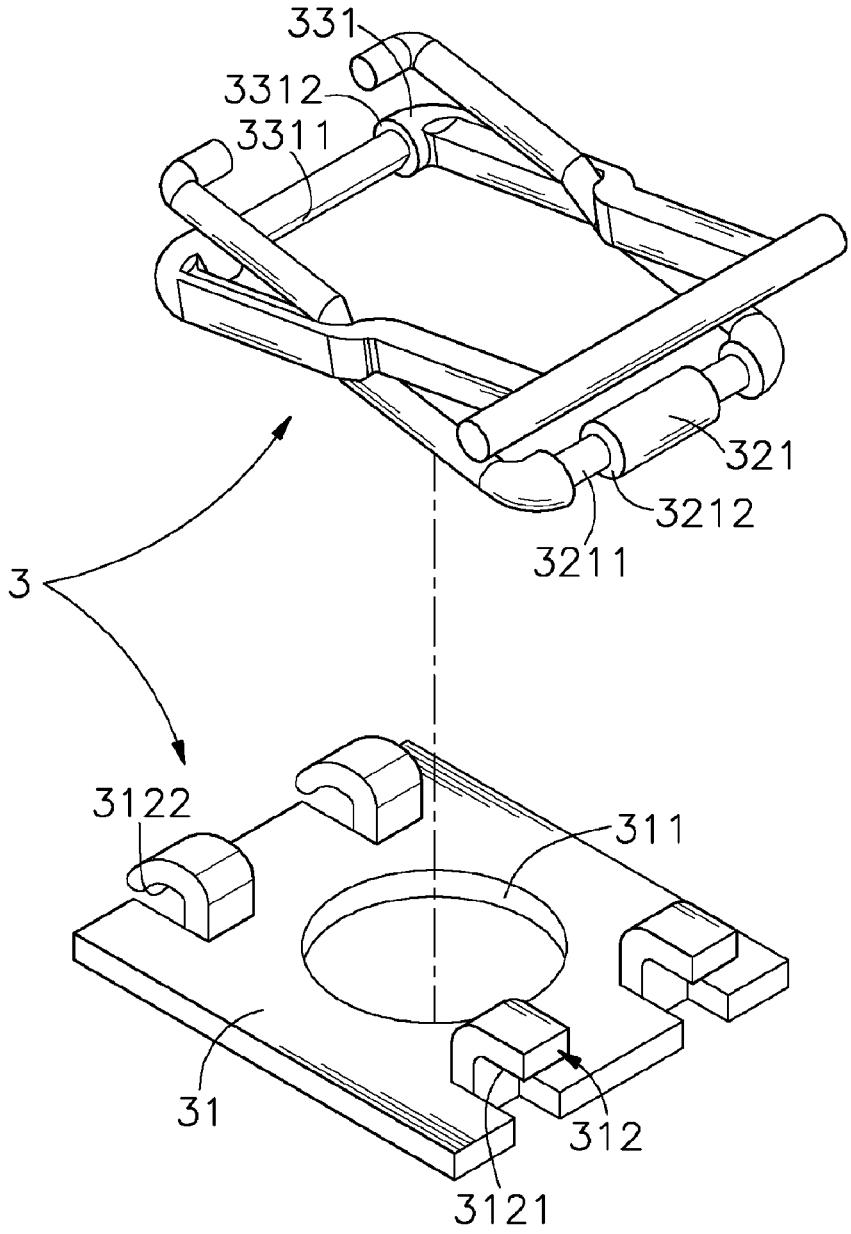
FIG. 7 is an exploded view of a linking mechanism for a key switch structure in accordance with a second embodiment of the present invention.

FIG. 7 illustrates a linking mechanism 3 for a key switch structure in accordance with a second embodiment of the present invention. According to this second embodiment, the linking mechanism 3 comprises a positioning board 31, a first link 32 and a second link 33. The positioning board 31 comprises an opening 311 for the passing of the elastically deformable hollow actuation member 121 of the rubber membrane 12 (see also FIG. 2), and two pairs of coupling portions 312 upwardly extended from the top wall thereof and bilaterally symmetrically disposed at two opposite sides relative to the opening 311. Each coupling portion 312 defines a coupling groove 3121. Further, each of one pair of coupling portions 312 has its free end curving downwards, defining a stop surface portion 3122. The first link 32 according to this second embodiment is substantially similar to that of the aforesaid first embodiment with the exception that the cylindrical base 321 of the first link 32 according to this second embodiment has two neck portions 3211 respectively coupled to the coupling grooves 3121 of one pair, namely, the first pair of coupling portions 312 of the positioning board 31, and two stop edges 3212 disposed at two ends of each neck portion 3211 and respectively stopped at two sides of each of the first pair of coupling portions 312. The second link 33 according to this second embodiment is substantially similar to that of the aforesaid first embodiment with the exception that the cylindrical base 331 of the second link 33 according to this second embodiment has a cut plane 3311 and two stop edges 3312 respectively disposed at the two distal ends of the cut plane 3311. During installation, the cylindrical base 331 of the second link 33 must be rotated to a particular angle relative to the positioning board 31 so that the cut plane 3311 can be forced into the coupling grooves 3121 of the other pair, namely, the second pair of coupling portions 312 of the positioning board 31 to have the two stop edges 3312 be respectively stopped against the second pair of coupling portions 312 of the positioning board 31 at an outer side. After coupling of the cylindrical base 331 of the second link 33 to the coupling grooves 3121 of the second pair of coupling portions 312 of the positioning board 31, the two neck portions 3211 of the cylindrical base 321 of the first link 32 are respectively coupled to the coupling grooves 3121 of the first pair of coupling portions 312 of the positioning board 31. Alternatively, the cylindrical base 321 of the first link 32 can be made having the aforesaid cut plane and the related two stop edges, and the cylindrical base 331 of the second link 33 can be made having the aforesaid two neck portions and two stop edges at two ends of each neck portion.

Figure 8:
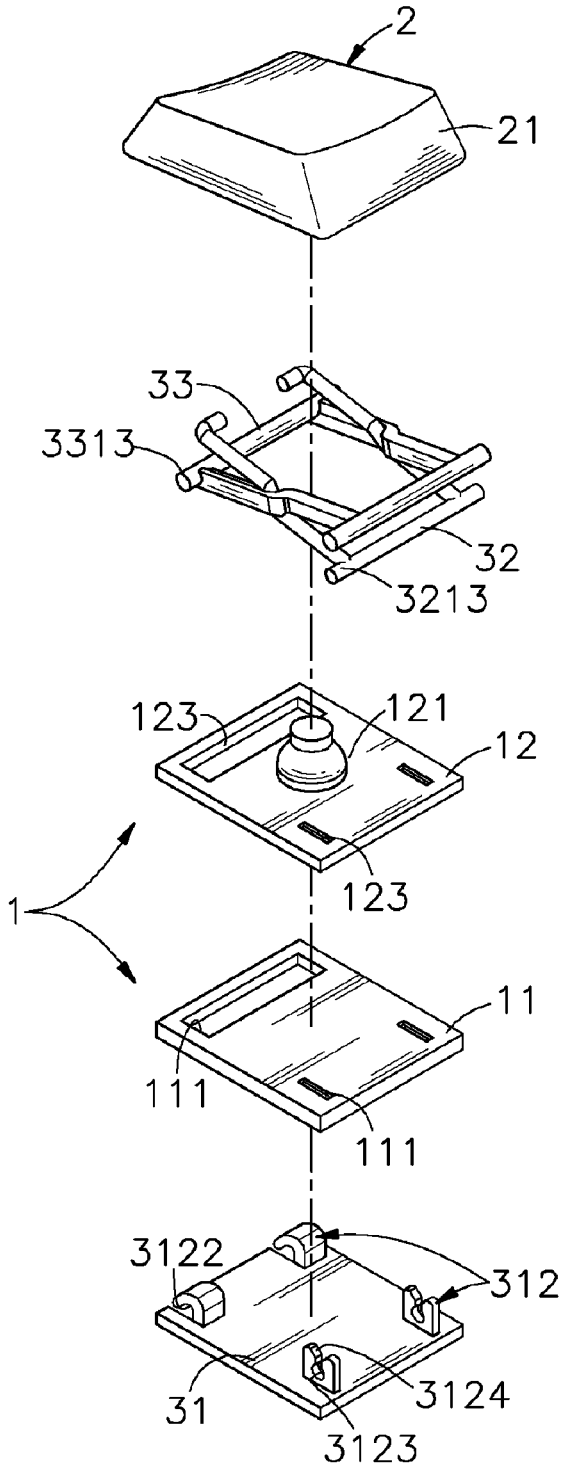
FIG. 8 is an exploded view of a key switch structure for input device in accordance with a third embodiment of the present invention.
Figure 9:
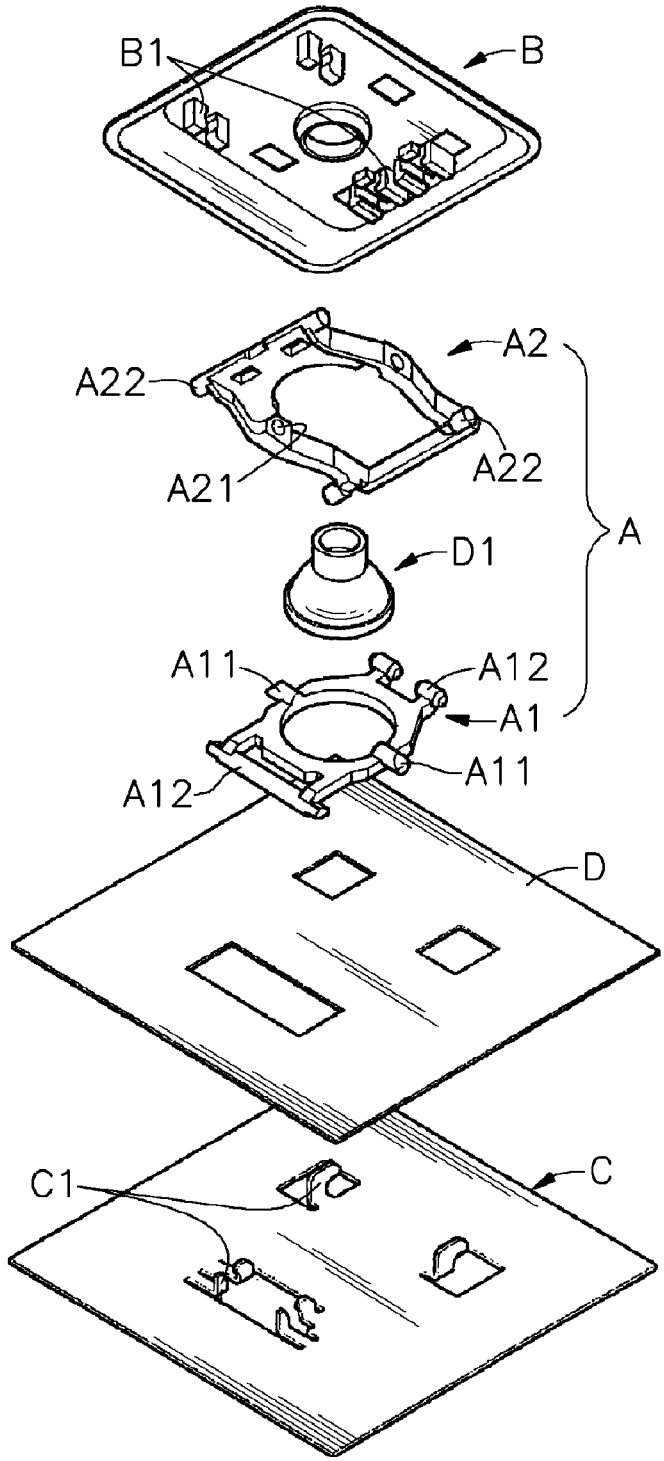
PRIOR ART FIG. 9
FIG. 9 is an exploded view of a key switch structure for input device according to the prior art.

FIG. 8 illustrates a key switch structure in accordance with a third embodiment of the present invention. According to this third embodiment, the positioning board 31 of the linking mechanism 3 is positioned on the bottom side of the circuit board 11 of the circuit module 1 opposite to the rubber membrane 12 with the first and second pairs of coupling portions 312 thereof respectively inserted through respective insertion holes 111 on the circuit board 11 and respective insertion holes 123 on the rubber membrane 12; the cylindrical base 321 of the first link 32 has two coupling ends 3213 thereof respectively forced through respective sloping guide surface portions 3124 into respective water drop-like coupling holes 3123 in the first pair of coupling portions 312 of the positioning board 31; the cylindrical base 331 of the second link 33 has two coupling ends 3313 thereof respectively coupled to respective coupling grooves 3121 in the second pair of coupling portions 312 of the positioning board 31 and stopped against the respective stop surfaces 3122 of the second pair of coupling portions 312. After coupling of the cylindrical bases 321 and 331 of the first and second links 32 and 33 to the coupling portions 312 of the positioning board 31, the trapezoidal key cap body 21 of the key cap 2 is coupled to the (pivot pins 325 of the) first link 32 and the (transverse coupling rod 335 of the) second link 33 in the same manner as the aforesaid first embodiment. When assembled, a user can press the trapezoidal key cap body 21 of the key cap 2 to move the first link 32 and the second link 33 in scissor action and to further compress the elastically deformable hollow actuation member 121, causing the elastically deformable hollow actuation member 121 to trigger the corresponding switching contact of the circuit board 11 for producing a corresponding control signal.

According to the aforesaid various embodiments of the present invention, the positioning board 31 can be made having two, three or four coupling portions 312 for the coupling of the cylindrical bases 321 and 331 of the first and second links 32 and 33. Further, the first and second links 32 and 33 can be made of metal, plastics, reinforced plastics or any other suitable material. Further, the input device in which the key switch structure is used can be a computer mouse or keyboard for data entry, or a game machine joystick or light gun for command entry.

As stated above, the key switch structure of the present invention is characterized by the arrangement of the linking mechanism 3 between the circuit module 1 and the key cap 2, wherein the first link 32 and the second link 33 extend across each other and are movable in scissor action to lower or lift the key cap 2 while keeping the key cap 2 in balance. During down or up stroke of the key cap 2, the oblique bearing portions 323 of the first link 32 are respectively supported on the shoulders 333 of the second link 33 so that the pressure applied by a user to the key cap 2 can be evenly applied to the elastically deformable hollow actuation member 121 of the rubber membrane 12 to compress the rubber membrane 12 vertically, forcing the contact portion 122 to trigger the corresponding switching contact of the circuit board 11 for producing a corresponding control signal.

In conclusion, the key switch structure for input device in accordance with the present invention has the following features and advantages:

1. The linking mechanism 3 has the oblique bearing portions 323 of its first link 32 respectively supported on the shoulders 333 of its second link 33 in a crossed manner such that the first link 32 and the second link 33 are moved in scissor action to support the key cap 2 in balance when a user pressed the key cap 2 to trigger the circuit module 1. The design of the linking mechanism 3 facilitates quick installation of the key switch structure by an automatic assembling tool. Therefore, the key switch structure for input device in accordance with the present invention is suitable for mass production to improve the productivity and to lower the manufacturing cost.

2. The first link 32 and the second link 33 extend across each other and are movable in scissor action to lower or lift the key cap 2 while keeping the key cap 2 in balance. During down or up stroke of the key cap 2, the oblique bearing portions 323 of the first link 32 are respectively supported on the shoulders 333 of the second link 33 so that the pressure applied by a user to the key cap 2 can be evenly applied to the elastically deformable hollow actuation member 121 of the rubber membrane 12 to compress the rubber membrane 12 vertically, forcing the contact portion 122 to trigger the corresponding switching contact of the circuit board 11 for producing a corresponding control signal accurately.

3. When the key cap 2 is pressed and lowered to the lower limit position where the contact portion 122 of the associating elastically deformable hollow actuation member 121 touches the respective switching contact of the circuit board 11, the first link 32 is received in the recessed receiving portions 3332 at the inner sides of the lower arms 332 and upper arms 334 of the second link 33, therefore, the scissor-action design of the first and second links 32 and 33 of the linking mechanism 3 enables the height of the elastically deformable hollow actuation member 121 to be minimized, satisfying low-profile requirements A prototype of key switch structure for input device has been constructed with the features of FIGS. 1~8. The key switch structure functions smoothly to provide all of the features disclosed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A key switch structure, comprising a circuit module, a key cap, and a linking mechanism set between said key cap and said circuit module to guide vertical movement of said key cap relative to said circuit member for enabling said key cap to be pressed by a user to trigger said circuit module in producing a control signal, wherein said linking mechanism comprises:

a positioning board fastened to said circuit module, said positioning board comprising at least one first coupling portion and at least one second coupling portion;

a first link obliquely coupled between said at least one first coupling portion of said positioning board and said key cap, said first link comprising a cylindrical base coupled to said at least one first coupling portion of said positioning board and two oblique bearing portions bilaterally disposed on the middle; and a second link obliquely coupled between said at least one second coupling portion of said positioning board and said key cap and extending across said first link, said second link comprising a cylindrical base coupled to said at least one second coupling portion of said positioning board and two shoulders bilaterally disposed on the middle, said shoulders supporting said oblique bearing portions of said first link respectively for enabling said first link and said second link to be moved in scissor action when said key cap is pressed by a user.

2. The key switch structure as claimed in claim 1, wherein said circuit module comprises a circuit board, said circuit board comprising a switching contract corresponding to said key cap, and a rubber membrane stacked on said circuit board, said rubber membrane comprising a vertically compressible and elastically deformable hollow actuation member attached to a bottom side of said key cap and spaced above said switching contact of said circuit board, said vertically compressible and elastically deformable hollow actuation member comprising a contact portion downwardly extended from a top thereof and spaced above said switching contact of said circuit board and adapted for triggering said switching contact of said circuit board when said vertically compressible and elastically deformable hollow actuation member is compressed by said key cap.

3. The key switch structure as claimed in claim 1, wherein said key cap comprises a key cap body, a bottom accommodation space defined in a bottom side of said key cap body for accommodating said first link and said second link, at least one first coupling device and at least one second coupling device bilaterally disposed in said bottom accommodation space and respectively coupled to said first link and said second link.

4. The key switch structure as claimed in claim 3, wherein the number of the at least one first coupling device of said key cap is 2, and each said first coupling device comprises a downwardly extending water drop-like coupling hole and a smoothly curved guide surface portion disposed at a bottom side of said downwardly extending water drop-like coupling hole for guiding said first link into said downwardly extending water drop-like coupling hole; said first link further comprises two pivot pins respectively pivotally coupled to said downwardly extending water drop-like coupling holes of said two first coupling devices of said key cap.

5. The key switch structure as claimed in claim 3, wherein the number of the at least one second coupling device of said key cap is 2, and each said second coupling device comprises a horizontal sliding groove, and a bottom entrance in communication with said horizontal sliding groove; said second link further comprises a transverse coupling rod disposed in parallel to said cylindrical base of said second link and inserted through said bottom entrance of each said second coupling device of said key cap and pivotally coupled to said horizontal sliding groove of each said second coupling device of said key cap.

6. The key switch structure as claimed in claim 2, wherein said positioning board comprises an opening for the passing of said vertically compressible and elastically deformable hollow actuation member; said least one first coupling portion and at least one second coupling portion of said positioning board each define a coupling groove for receiving said cylindrical base of one of said first link and said second link.

7. The key switch structure as claimed in claim 1, wherein said first link comprises two lower arms respectively connected between two distal ends of said cylindrical base of said first link and said two oblique bearing portions, two pivot pins respectively pivotally coupled to said at least one first coupling device of said key cap, and two upper arms respectively connected between said two pivot pins and said oblique bearing portions.

8. The key switch structure as claimed in claim 1, wherein said second link comprises two lower arms respectively connected between two distal ends of said cylindrical base of said second link and said two shoulders, a transverse coupling rod pivotally coupled to said at least one second coupling device of said key cap, and two upper arms respectively connected between two distal ends of said transverse coupling rod and said two shoulders.

9. The key switch structure as claimed in claim 8, wherein said second link further comprises two locating notches respectively formed on said shoulders at an inner side and adapted for accommodating said oblique bearing portions of said first link respectively, and two recessed receiving portions respectively extended from two opposite sides of each said locating notches for receiving said first link.

10. The key switch structure as claimed in claim 9, wherein said second link further comprises a plurality of chamfered edges disposed around each said locating notch.

11. The key switch structure as claimed in claim 2, wherein said circuit board comprises a plurality of insertion holes; said rubber member comprises a plurality of insertion holes corresponding to said insertion holes of said circuit board; said positioning board of said linking mechanism is attached to a bottom side of said circuit board opposite to said rubber membrane; said at least one first coupling portion and at least one second coupling portion of said positioning board are respectively inserted through said insertion holes of said circuit board and said insertion holes of said rubber membrane and respectively coupled to said first link and said second link.

12. The key switch structure as claimed in claim 11, wherein the number of said at least one second coupling portion of said positioning board is 2, and each second coupling portion of said positioning board comprises a coupling groove; said cylindrical base of said second link comprises two coupling ends respectively coupled to said coupling grooves in said two second coupling portions of said positioning board.

13. The key switch structure as claimed in claim 11, wherein the cylindrical base of said first link comprises two neck portions respectively coupled to said at least one first coupling portion of said positioning board.

14. The key switch structure as claimed in claim 11, wherein each said second coupling portion comprises a coupling groove for receiving said cylindrical base of said second link, and a stop surface for stopping said cylindrical base of said second link in said coupling groove of said associating second coupling portion; said cylindrical base of said second link comprises a cut plane for enabling said cylindrical base of said second link to be inserted into said coupling groove of each said second coupling portion at a predetermined angle, and two stop edges respectively disposed at two distal ends of said cut plane and respectively stopped against said at least one second coupling portion of said positioning board at an outer side.

15. The key switch structure as claimed in claim 11, wherein each first coupling portion of said positioning board comprises a water drop-like coupling hole for receiving said cylindrical base of said first link, and a sloping guide surface portion for guiding said cylindrical base of said first link into said water drop-like coupling hole of each said first coupling portion of said positioning board.

16. The key switch structure as claimed in claim 1, wherein said first link and said second link are made of metal.

17. The key switch structure as claimed in claim 1, wherein said first link and said second link are made of a plastic material.

* * * * *